US005479807A

United States Patent [19]

Moser

[11] Patent Number: 5,479,807

[45] Date of Patent: Jan. 2, 1996

[54] COILER FURNACE FOR A HOT STRIP

[75] Inventor: Friedrich Moser, St. Florian, Austria

[73] Assignee: Voest-Alpine Industrieanlagenbau GmbH, Linz, Austria

[21] Appl. No.: 202,955

[22] Filed: Feb. 28, 1994

[30] Foreign Application Priority Data

Mar. 5, 1993 [AT] Austria ..... A 426/93

[51] Int. Cl.[6] ..... B21C 47/00; B21B 41/06

[52] U.S. Cl. ..... 72/202; 72/148; 72/229

[58] Field of Search ..... 72/142, 146, 148, 72/202, 229, 39; 242/562, 562.1, 564.4, 532.6, 532.7; 29/81.11

[56] References Cited

U.S. PATENT DOCUMENTS

| | | | |
|---|---|---|---|
| 2,675,720 | 4/1954 | Ferm | 72/148 |
| 3,834,204 | 9/1974 | Ihle | 72/183 |
| 4,047,416 | 9/1977 | Johnson | 72/183 |
| 4,761,983 | 8/1988 | Ginzburg et al. | 72/148 |

FOREIGN PATENT DOCUMENTS

| | | |
|---|---|---|
| 938379 | 1/1956 | Germany . |
| 948603 | 9/1956 | Germany . |

*Primary Examiner*—Lowell A. Larson
*Assistant Examiner*—Rodney Butler
*Attorney, Agent, or Firm*—Collard & Roe

[57] ABSTRACT

A hot strip coiler furnace is disclosed, which comprises a furnace hood, a drivable coiler drum, which is accommodated in the furnace hood and has a strip-receiving opening for receiving the leading end of the incoming strip, and a strip-receiving guide, which has a delivery end adjacent to the strip-receiving opening of the coiler drum when it is in a strip-receiving position. In order to permit the hot strip to be completely pulled into the coiler furnace, it is proposed that a strip-delivering guide for the outgoing strip is provided, which guide protrudes or is adapted to be introduced into the generally triangular space which is defined by the coil of strip and the incoming or outgoing strip.

11 Claims, 5 Drawing Sheets

COILER FURNACE FOR A HOT STRIP

BACKGROUND OF THE INVENTION

1. Field of the Invention

This invention relates to a hot strip coiler furnace comprising a furnace hood, a drivable coiler drum, which is accommodated in the furnace hood and has a strip-receiving opening for receiving the leading end of the incoming strip, and a strip-receiving guide, which has a delivery end adjacent to the strip-receiving opening of the coiler drum when it is in a strip-receiving position, wherein the coiler drum is adapted to be driven to rotate in a sense corresponding to the direction in which the leading end of the strip is inserted into the strip-receiving opening and is adjustable in dependence on the diameter of the coil of strip along a coiler drum guide, which is transverse to the longitudinal and transverse directions of the incoming strip.

2. Description of the Prior Art

When strip is hot-rolled by means of a reversing stand, said stand is preceded and succeeded by respective coiler furnaces so that the strip can be uncoiled from one coiler furnace and rolled in the reversing stand and then coiled in the other coiler furnace. For that purpose it is conventional to provide coiler furnaces which as disclosed in U.S. Pat. No. 4,761,983 comprise a heat-insulated furnace hood and a coiler drum, which is accommodated in the furnace hood and has a strip-receiving opening for receiving the leading end of the incoming strip, which is supplied on a roller table and is guided into the furnace along a strip-receiving guide, which is generally constituted by a pivoted flap. The leading end of the incoming strip is inserted along the strip-receiving guide into the receiving opening of the coiler drum, which for that purpose must be rotated to a strip-receiving position. To clamp the leading end of the strip in the strip-receiving opening of the coiler drum, the coiler drum is driven to rotate in a sense which is opposite to the direction in which the incoming strip is moved so that the leading end of the incoming strip is bent around that edge of the strip-receiving opening which is the trailing edge in the coiling sense. The contact between the strip and the shell of the coiler drum is assisted by pressure-applying rollers, which are rotatably mounted in a rocker and which by a cylinder that acts on the rocker are forced against the coiler drum and the convolutions of the strip surrounding the coiler drum. After the first convolutions of the strip have been formed the pressure-applying rollers are disengaged from the coil of strip. A disadvantage of that known coiler furnace resides in that the incoming strip is displaced transversely to its longitudinal and transverse directions in dependence on the increase of the diameter of the coil of strip and is thus caused to vibrate and that vibration has an adverse effect on the quality of the strip and may give rise to difficulties in the driving of the coiler drum because the vibration must be suppressed by a higher strip tension. Besides, it is not possible to pull the hot strip completely into the coiler furnace so that that end of the strip which does not enter the coiler furnace is undesirably cooled.

It is also known (from DE-A-948-603 and DE-A-938, 379) to drive the coiler drum in the sense corresponding to the direction of movement of the leading end of the strip into the strip-receiving opening and to adjust the coiler drum in dependence on the diameter of the coil of strip along a guide which is transverse to the longitudinal and transverse directions of the incoming strip. As a result, the transverse displacement of the incoming strip can be restricted. A disadvantage of that known coiler furnace resides also in that the hot strip cannot completely be coiled on the coiler drum because it would otherwise be impossible to pull the strip from the coiler drum so that in case of a standstill of the rolling mill plant the strip which cannot completely be introduced into the coiler furnace must be rejected as a scrap.

SUMMARY OF THE INVENTION

For this reason it is an object of the invention so to improve by the use of simple means a hot strip coiler furnace of the kind described first hereinbefore that the hot strip can completely be pulled into the coiler furnace.

The object set forth is accomplished in accordance with the invention in that a strip-delivering guide for the outgoing strip is provided, which guide protrudes or is adapted to be introduced into the generally triangular space which is defined by the coil of strip and the incoming or outgoing strip.

Because the coiler drum is adjusted transversely to the longitudinal and transverse directions of the incoming strip in dependence on the diameter of the coil of strip, the triangular space between the coil of strip and the incoming strip is maintained in a fixed position. For this reason it is simple to provide for the outgoing strip a strip-delivering guide, which protrudes or can be introduced into that triangular space. When the hot strip has completely been pulled into the coiler furnace, that strip-receiving guide will catch the outer end of the coiled strip, which end slightly protrudes from the coil of strip and is guided out of the furnace as the rotation of the coiler drum is continued.

The constant coiling conditions result not only in a desirable utilization of the space adjacent to the incoming strip but simplify also the coiling operation, which may additionally be assisted in that at least one pressure-applying roller is associated with the coiler drum and is held on a stationary axis at least during the coiling operation, and the coiler drum is forced by a predetermined force against said pressure-applying roller. That roller may be constituted by a roller of a roller table, which extends through the coiler furnace below the coiler drum, so that a particularly simple design will be obtained and it is possible to forward the strip below the furnace past the coiler drum rather than to coil the strip in the furnace.

If the coiler is driven in a sense corresponding to the movement of the incoming strip, scale may fall from the coil of strip onto the incoming strip and it will be essential to prevent that if high quality requirements must be met. Because the transverse displacement of the coiler drum in dependence on the diameter of the coil of strip will ensure the maintenance of a substantially constant position of the triangular space between the incoming strip and the coil of strip, a scale collector may protrude into that triangular space between the coil of strip and the incoming or outgoing strip so that it is possible by the use of simple means to preclude falling scale from deteriorating the surface quality of the strip. Because the strip-delivering guide and the scale collector will be provided in the triangular space between the coil of strip and the incoming or outgoing strip, said two elements may desirably be combined in a common device for performing both functions.

A further advantage will be afforded if a second strip-delivering guide, which is movable to a position close to the coil of strip, is spaced from the strip-receiving guide and said second strip-delivering guide is succeeded by a pair of pinch rollers. In that case the strip can be paid off not only on that side of the coiler furnace on which the incoming strip is received but also on the opposite side. To ensure that the heat insulation of the coiler furnace is not adversely affected by that additional pay-off mode, the second strip-delivering guide can be moved between an operative position, in which the second strip-delivering guide is close to the coil of strip, and an inoperative position, in which the second strip-delivering guide closes a strip-delivering opening in the furnace hood. In such an arrangement, the pair of pinch rollers may comprise a driven roller, which is adjacent to the coil of strip and desirably constitutes a pressure-applying roller, which is rotatably mounted on a stationary axis and can be used to assist the coiling of the first convolutions of the incoming strip and the paying off in that a corresponding converying force is exerted on the strip being to be paid off.

In accordance with a further feature of the invention, the drive means for adjusting the coiler drum along the coiler drum guide may consist of two drive units, which are operatively connected to respective ends of the coiler drum and are separately controllable. In that case said separately controllable drive units may be used to pivot the coiler drum about a pivotal axis which extends in the longitudinal direction of the incoming strip so that the lateral wandering can be compensated which must often be expected in the operation of reversing stands.

DETAILED DESCRIPTION OF THE PREFERRED EMBODIMENTS

Figure 1:
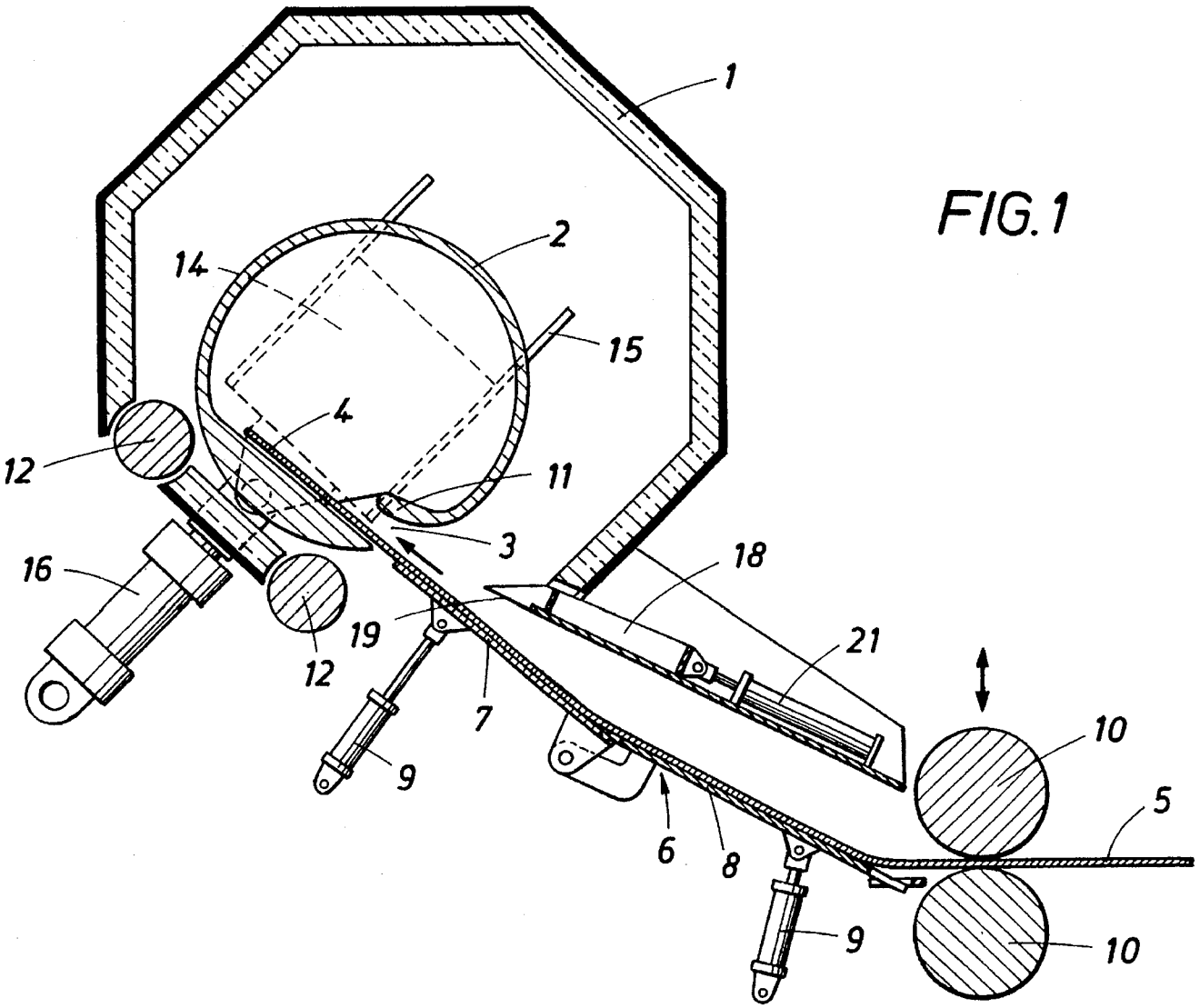
FIG. 1 is a simplified longitudinal sectional view showing an illustrative embodiment of a coiler furnace in accordance with the invention in the strip-receiving position.
Figure 3:
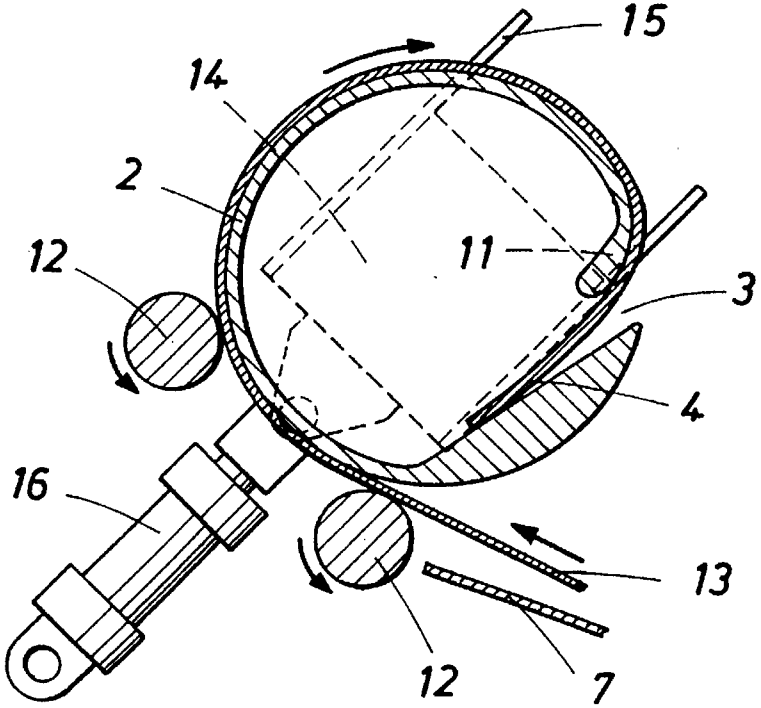
FIGS. 2 and 3 are transverse sectional views showing the coiler drum of the coiler furnace of FIG. 1 in respective angular positions assumed at the beginning of the coiling operation.
Figure 2:
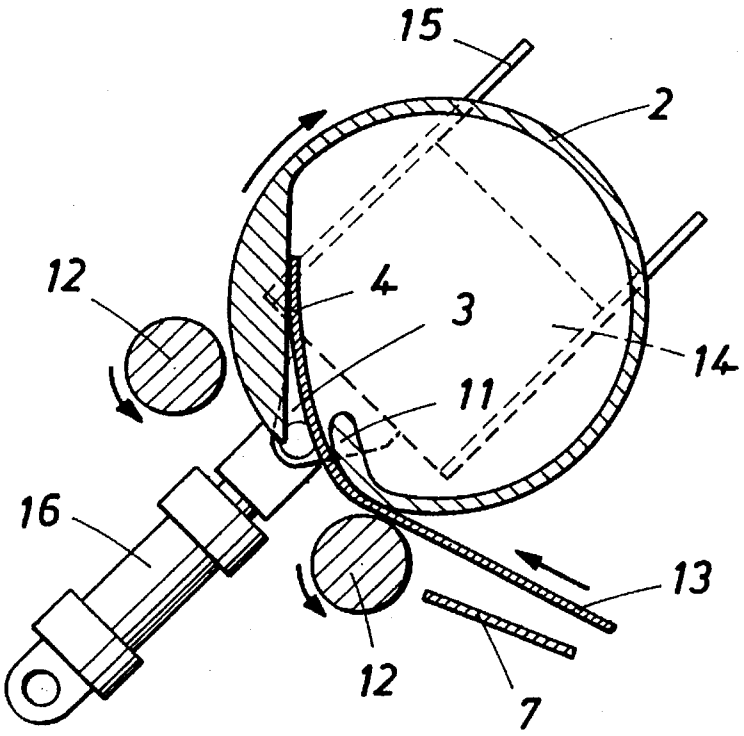
Figure 4:
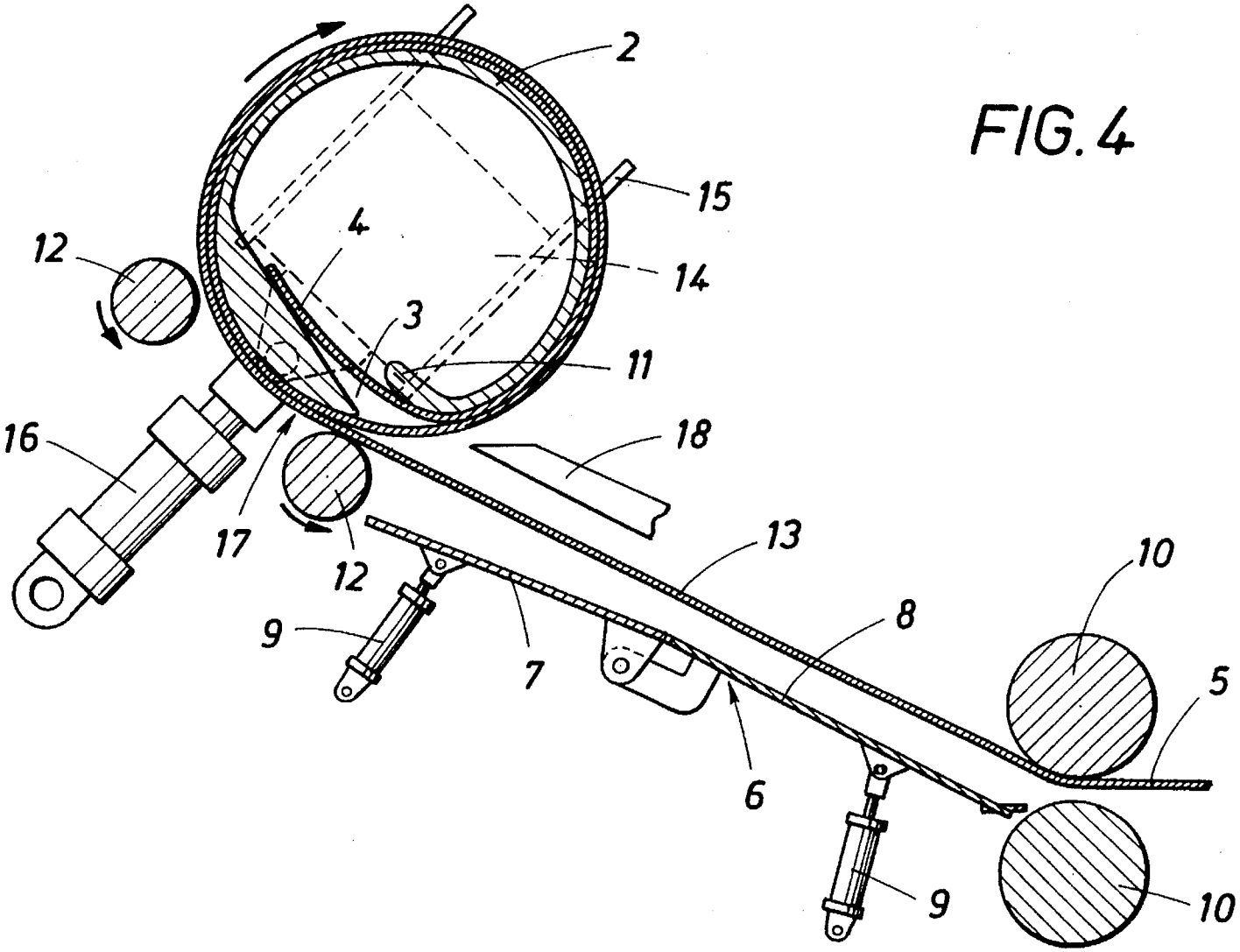
FIG. 4 is a transverse sectional view showing the coiler drum and illustrating the incoming strip as it is coiled.

Illustrative embodiments of the invention will now be described more in detail with reference to the drawings.

In the embodiment shown in FIGS. 1 to 5 the coiler furnace in accordance with the invention comprises a heat-insulated furnace hood 1, which contains a hollow coiler drum 2, the shell of which is formed with a strip-receiving opening 3 for receiving the leading end 4 of the incoming strip 5 which is to be coiled. To permit an inserting of the leading end 4 of the incoming strip into the strip-receiving opening 3 of the coiler drum 2, a strip-receiving guide 6 is provided, which comprises two hingedly connected pivoted flaps 7 and 8, each of which is angularly adjustable by an associated swivel cylinder 9. In the strip-receiving position shown in FIG. 1 the delivery end of the strip-receiving guide 6 is disposed adjacent to the strip-receiving opening 3 so that the leading end 4 of the incoming strip 5 will be inserted into the coiler drum 2 through the strip-receiving opening 3 in a predetermined direction. In that operation the conveyance of the incoming strip is assisted by a pair of pinch rollers 10, which precede the strip-receiving guide 6. When the leading end 4 of the incoming strip has been inserted into the coiler drum 2 the latter is driven in a sense corresponding to the direction of movement of the incoming strip so that the leading end 4 is bent about that edge 11 of the strip-receiving opening 3 which is the trailing edge in that sense of rotation of the coiler drum. That trailing edge 11 constitutes a correspondingly curved surface for contacting the leading end 4. Because the coiler drum is being rotated in a sense corresponding to the direction of movement of the incoming strip the leading end 4 of the incoming strip is bent through a smaller angle than the leading end of an incoming strip would be bent in a coiler drum which is rotated in the opposite sense to coil the strip. For this reason the coiler furnace may be used to coil thicker strip without a risk of a formation of cracks in the strip. Besides, the incoming strip will be raised to a smaller extent at the transition from each convolution to the next so that the smaller vibrations will be excited in the incoming strip and the transition between the radii of two consecutive convolutions of the strip being coiled will be improved.

The coiling of the leading end 4 of the incoming strip on the coiler drum 2 is assisted by two driven pressure-applying rollers 12, each of which is rotatably mounted on a stationary axis. The coiler drum 2 is displaceable relative to said pressure-applying rollers transversely to the longitudinal and transverse directions of the incoming strip 13. For that purpose the bearing brackets 14 for the coiler drum 2 are slidably mounted at both ends of the coiler drum 2 in a properly aligned drum-adjusting guide 15. The drive for displacing the coiler drum 2 consists of two drive units 16, specifically two driving cylinders, which are operatively connected to respective ends of the coiler drum, so that the coiler drum 2 can be displaced parallel to itself and can be swiveled about an axis which extends in the longitudinal direction of the incoming strip. That fact is of special significance for the compensation of a lateral wandering of the strip because the incoming strip 13 which has laterally wandered can be returned to a centered position in that the coiler drum 2 is adjusted to a correspondingly inclined position. To initiate the coiling of the strip in the position shown in FIGS. 2 and 3 the coiler drum 2 is adjusted to assume relative to the stationary pressure-applying rollers 12 such a position that the clearance between each pressure-applying roller 12 and the outside peripheral surface of the coiler drum equals the thickness of the strip. As a result, the driven pressure-applying rollers 12 assist the deflecting of the incoming strip 13 and its contact with the shell of the drum, as is apparent from FIGS. 2 and 3. When the leading end 4 of the incoming strip has been inserted into the coiler drum 2 the strip-receiving guide 6 is no longer required and the pivoted flaps 7 and 8 are then swung from their operative position shown in FIG. 1 to an inoperative position, which is shown, e.g., in FIG. 4. Because that pressure-applying roller 12 which is first contacted by the incoming strip is stationary, the coiler furnace will be substantially closed by the pivoted flaps 7 and 8 even when the strip-receiving guide 6 is in its inoperative position. After a few convolutions of strip have been coiled, it is no longer necessary to force the incoming strip 13 against the shell of the drum and the coiler drum 2 may then slightly be disengaged from the pressure-applying rollers 12.

Figure 5:
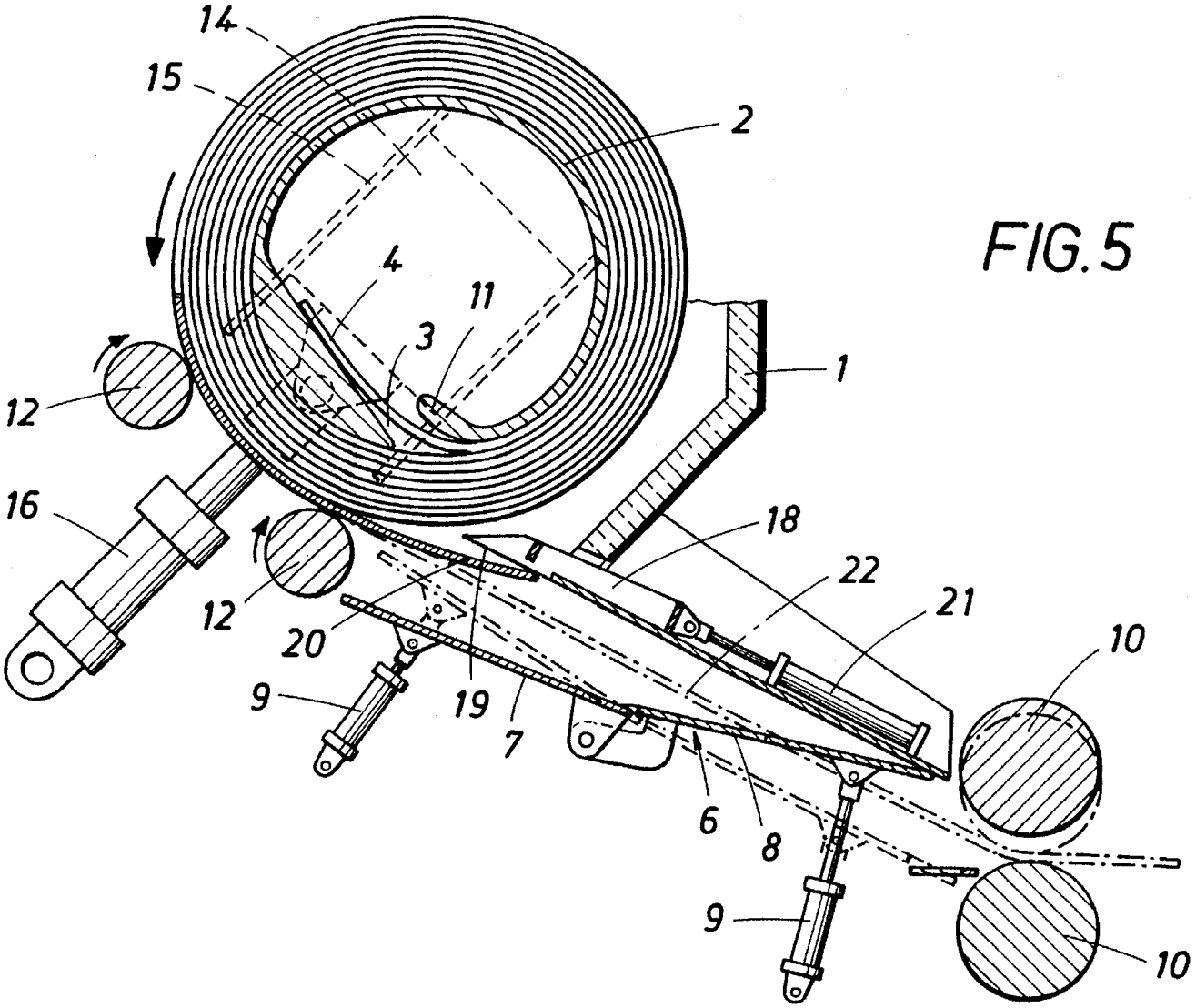
FIG. 5 is a longitudinal sectional view showing the coiler furnace of FIG. 1, which is provided with a strip-delivering guide.

In order to preclude or minimize a vibration of the strip which might be caused by a lateral wandering of the incoming strip 13 and to ensure a steady movement of the strip as it is coiled, the drive units 16 are operated after each revolution of the coiler drum 2 to move the coiler drum 2 away from the stationary pressure-applying rollers 12 to an extent which corresponds to the thickness of the strip. As a result, the location 17 at which the incoming strip 13 initially contacts the coil of strip being formed will be maintained constant and the incoming strip 13 will always assume the same position between the opened pair of pinch rollers 10 and the location of initial contact 17. These geometric conditions adjacent to the incoming strip 13 will be maintained constant by the transverse displacement of the coiler drum 2 and permit the provision of a scale collector 18 in the triangular space between the incoming strip 13 and the coiler drum 2 or the coil of strip which has been formed on the coiler drum 2. That scale collector 18 prevents a dropping of scale from the coil of strip onto the incoming strip 13. That scale collector 18 may also be used as a strip-delivering guide 19 after the strip has been completely coiled on the coiler drum 2 so that the outer end 20 of the strip protrudes from the coil of strip and it is desired to catch the outer end 20 of the strip and to guide it out of the coiler furnace, as is illustrated in FIG. 5. For that purpose the strip-delivering guide 19 is advanced toward the coil of strip by an actuating cylinder 21 to a position in which the strip-delivering guide 19 is advanced toward the coil of strip by an actuating cylinder 21 to a position in which the strip-delivering guide 19 can catch the protruding outer end 20 of the strip and guide said outer end against the pair of pinch rollers 10. The pivoted flaps 7 and 8 have previously been pivotally moved from the position in which they are shown in solid lines and close the furnace to the position indicated in phantom. To initiate the paying off of the strip, the coiler drum 2 is moved to force the coil of strip against the pressure-applying rollers 12, which in that phase act as pinch rollers. The paying off of the strip is then continued in conventional manner by the operation of the pinch rollers 10. In that case too the coiler drum 2 is transversely displaced toward the pressure-applying rollers 12 in dependence on the decreasing diameter of the coil of strip so that the outgoing strip 22 is also maintained in a constant position, as is indicated in phantom in FIG. 5.

Figure 6:
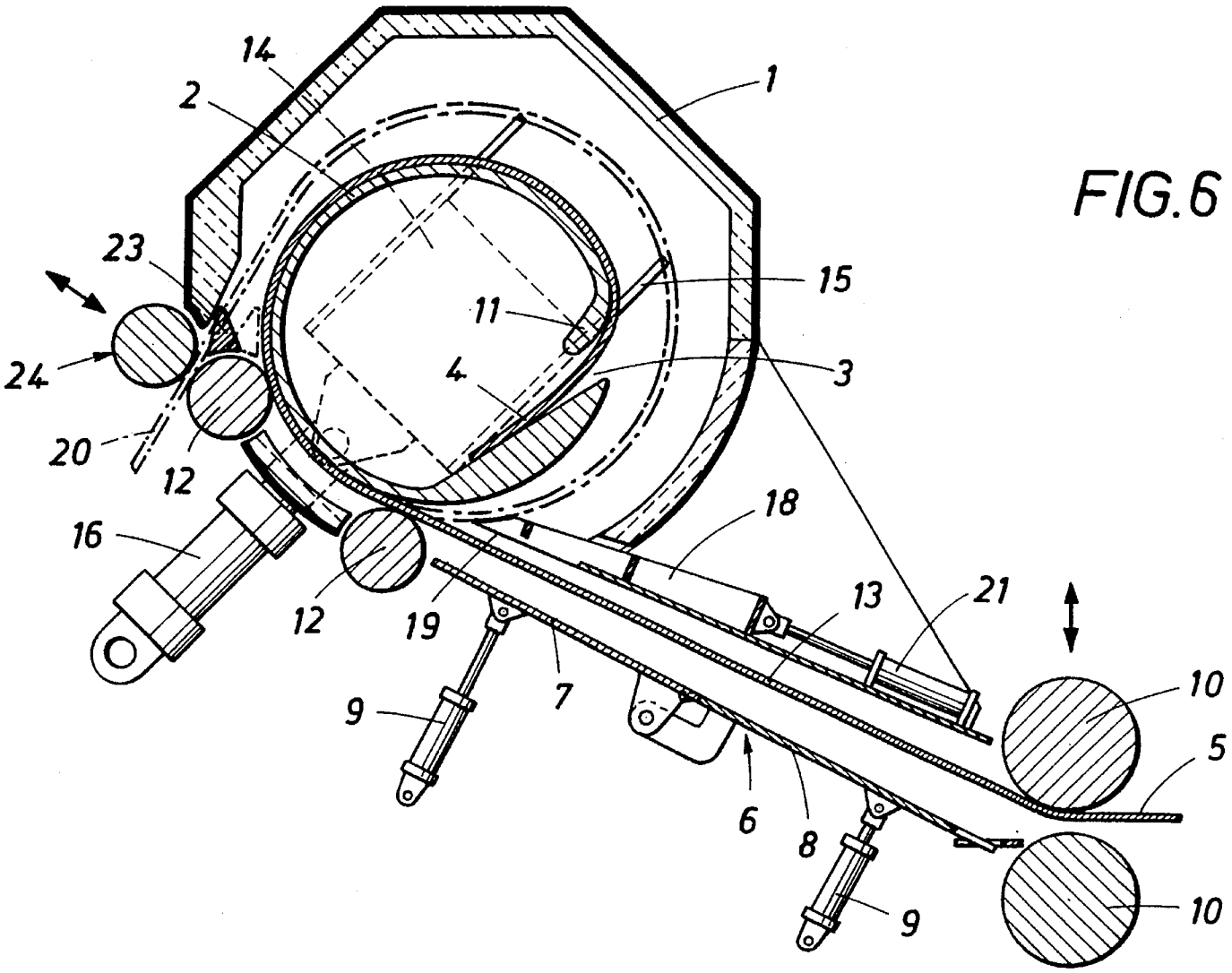
FIG. 6 is a schematic longitudinal sectional view showing another embodiment of the coiler furnace in accordance with the invention.

From the coiler furnace shown in FIG. 6 the strip can be paid off also on that side of the furnace which is opposite to the side on which the incoming strip is received. For that purpose a second strip-delivering guide 23 is provided, which is spaced from the strip-receiving guide 6 in a direction which is transverse to the coiler drum guide 15, and the second strip-delivering guide 23 is movable to a position in which it is close to the coil of strip and arranged to catch the outer end 20 of the strip and to guide said outer end 20 to a succeeding pair of pinch rollers 24. That of said pinch rollers 24 which engages the coil of strip is constituted by one of the stationary pressure-applying rollers 12. When the second strip-delivering guide 23 is in the position indicated in phantom in FIG. 6, the strip will be paid off on that side of the furnace which is opposite to the strip-receiving side. When the second strip-delivering guide 23 is in the position indicated in solid lines, the strip-delivering opening formed in the furnace adjacent to the second strip-delivering guide 23 will be closed.

It will be understood that the invention is not restricted to the embodiments shown by way of example. For instance, the pressure-applying rollers 12 may be adjustable in a direction which is normal to the incoming or outgoing strip so that the pressure-applying rollers 12 can be displaced from the coil of strip or from the coiler drum. Besides, clamping means may be provided for retaining the leading end of the incoming strip in the strip-receiving opening of the coiler drum.

I claim:

1. A coiler furnace comprising (a) a furnace hood, (b) a rotatable coiler drum mounted in said furnace hood and operable to coil a strip delivered to the drum in a predetermined direction and to pay off the coiled strip from the furnace hood, the strip having a leading end and a trailing end, an incoming strip portion being adjacent the leading end and an outgoing strip portion being adjacent the trailing end, the coiler drum having (1) a peripheral surface defining a receiving opening for receiving the leading strip end, and the coiler drum being rotatable in a first sense in said direction to coil the strip on the drum in a strip-receiving position and in a second sense opposite thereto to pay off the strip, the incoming and outgoing strip portions defining a triangular space with the coiled strip, (c) a strip-receiving guide having a delivery end disposed adjacent said receiving opening in the strip-receiving position of the coiler drum to guide the leading strip end into the receiving opening, (d) a strip-delivering guide adapted to catch the trailing strip end of the coiled strip upon rotation of the coiler drum in the second sense and to guide the trailing strip end out of the coiler furnace, (e) a coiler drum guide extending transversely to the longitudinal and transverse directions of the incoming strip portion, and (f) drum-adjusting means for displacing said coiler drum along said coiler drum guide in a first direction to an extent which increases with the diameter of said coiled strip during rotation of said coiler drum in the first sense so as to maintain said triangular space in a predetermined position.

2. The coiler furnace set forth in claim 1, wherein said drum-adjusting means are operable to adjust said coiler drum in a second direction, which is opposite to said first direction, during a rotation of said coiler drum in said second sense, to an extent which increases with the decrease of the diameter of said coil of strip as said outgoing strip is paid off from said coil of strip so as to maintain said triangular space in said predetermined position.

3. The coiler furnace set forth in claim 1, wherein at least one pressure-applying roller is rotatably mounted on a stationary axis and is adapted to engage said incoming strip during a rotation of said coiler drum in said first sense and said outgoing strip during a rotation of said coiler drum in second sense.

4. The coiler furnace set forth in claim 1, wherein said drum-adjusting means comprise two drive units, which are operatively connected to said coiler drum at opposite ends of said drum.

5. The coiler furnace set forth in claim 1, wherein said strip-delivering guide is mounted to be movable to and from a position in which said strip-delivering guide is arranged to catch said trailing end of said coiled strip during a rotation of said coiler drum in said second sense and then to guide said trailing end of said outgoing strip portion away from said coil of strip.

6. The coiler furnace set forth in claim 3, wherein said pressure-applying roller consists of a roller of a roller table which extends through the coiler furnace below said coiler drum.

7. A coiler furnace comprising (a) a furnace hood, (b) a rotatable coiler drum mounted in said furnace hood and operable to coil a strip delivered to the drum in a predetermined direction and to pay off the coiled strip from the furnace hood, the strip having a leading end and a trailing end, an incoming strip portion being adjacent the leading end and an outgoing strip portion being adjacent the trailing end, the coiler drum having (1) a peripheral surface defining a receiving opening for receiving the leading strip end, and the coiler drum being rotatable in a first sense in said direction to coil the strip on the drum in a strip-receiving position and in a second sense opposite thereto to pay off the strip, the incoming and outgoing strip portions defining a triangular space with the coiled strip, (c) a strip-receiving guide having a delivery end disposed adjacent said receiving opening in the strip-receiving position of the coiler drum to guide the leading strip end into the receiving opening, (d) a strip-delivering guide adapted to catch the trailing strip end of the coiled strip upon rotation of the coiler drum in the second sense and to guide the trailing strip end out of the coiler furnace, (e) a scale collector protruding into said triangular space, (f) a coiler drum guide extending transversely to the longitudinal and transverse directions of the incoming strip portion, and (g) drum-adjusting means for displacing said coiler drum along said coiler drum guide in a first direction to an extent which increases with the diameter of said coiled strip during rotation of said coiler drum in the first sense so as to maintain said triangular space in a predetermined position.

8. The coiler furnace set forth in claim 7, wherein said scale collector is constituted by said strip-delivering guide.

9. A coiler furnace comprising (a) a furnace hood defining a strip-delivering opening, (b) a rotatable coiler drum mounted in said furnace hood and operable to coil a strip delivered to the drum in a predetermined direction and to pay off the coiled strip from the furnace hood, the strip having a leading end and a trailing end, an incoming strip portion being adjacent the leading end and an outgoing strip portion being adjacent the trailing end, the coiler drum having (1) a peripheral surface defining a receiving opening for receiving the leading strip end, and the coiler drum being rotatable in a first sense in said direction to coil the strip on the drum in a strip-receiving position and in a second sense opposite thereto to pay off the strip, the incoming and outgoing strip portions defining a triangular space with the coiled strip, (c) a strip-receiving guide having a delivery end disposed adjacent said receiving opening in the strip-receiving position of the coiler drum to guide the leading strip end into the receiving opening, (d) a strip-delivering guide adapted to catch the trailing strip end of the coiled strip upon rotation of the coiler drum in the second sense and to guide the trailing strip end out of the coiler furnace, (e) a coiler drum guide extending transversely to the longitudinal and transverse directions of the incoming strip portion, (1) the strip-delivering opening of the furnace hood being spaced from said strip-receiving guide in a direction which is transverse to said coiler drum guide, (f) drum-adjusting means for displacing said coiler drum along said coiler drum guide in a first direction to an extent which increases with the diameter of said coiled strip during rotation of said coiler drum in the first sense so as to maintain said triangular space in a predetermined position, (g) a second strip-delivering guide adjacent said strip-delivering opening and adapted to catch the trailing end of the coiled strip during a rotation of the coiler drum in said second sense and then to guide the trailing end away from the coiled strip through said strip-delivering opening out of the coiler furnace, and (h) a pair of pinch rollers for conveying said outgoing strip portion from said second strip-delivering guide out of the coiler furnace.

10. The coiler furnace set forth in claim 9, wherein said pair of pinch rollers comprises a first and a second pinch roller, said first pinch roller being disposed closer to the coiled strip than said second pinch roller and being mounted rotatably on a stationary axis, and said first pinch roller being arranged to engage said incoming strip portion during rotation of said coiler drum in said first sense and to engage said outgoing strip portion during rotation of said coiler drum in said second sense.

11. The coiler furnace set forth in claim 9, wherein said second strip-delivering guide is movable between an operative position, in which said second strip-delivering guide is arranged to catch said trailing end of said coiled strip during a rotation of said coiler drum in said second sense and then to guide said trailing end and said outgoing strip portion away from said coiled strip through said strip-delivering opening out of said coiler furnace, and an inoperative position, in which said strip-delivering opening is substantially closed by said second strip-delivering guide and one of said pinch rollers.

* * * * *